United States Patent [19]

Vokey

[11] Patent Number: 4,518,034

[45] Date of Patent: May 21, 1985

[54] METHOD AND APPARATUS FOR MANUFACTURING CABLES HAVING COMPOSITE SHIELD AND ARMOR SHEATH DESIGNS

[75] Inventor: David E. Vokey, Hickory, N.C.

[73] Assignee: Canada Wire and Cable Limited, Don Mills, Canada

[21] Appl. No.: 521,372

[22] Filed: Aug. 8, 1983

[30] Foreign Application Priority Data

Aug. 10, 1982 [CA] Canada ..... 409130

[51] Int. Cl.[3] ..... H01B 13/22

[52] U.S. Cl. ..... 156/54; 29/745; 29/825; 156/56; 156/201; 156/206; 156/244.11; 156/461; 156/462; 156/467; 174/102 D; 174/106 D; 427/117

[58] Field of Search ..... 29/825, 745; 156/51, 156/54, 56, 201, 205, 206, 244.11, 461, 462, 467; 174/102 D, 106 D; 264/176 R, 209.11; 425/90; 427/117

[56] References Cited

U.S. PATENT DOCUMENTS 3,360,409 12/1967 Jachimowicz et al. ..... 228/130

3,785,048 1/1974 Petersen ..... 156/54 X

*Primary Examiner*—Robert A. Dawson

*Attorney, Agent, or Firm*—Fleit, Jacobson, Cohn & Price

[57] ABSTRACT

A process and apparatus for manufacturing a cable having a composite shield and armor sheath design is disclosed. The process comprises the steps of corrugating a laminated tape formed by bonding a plastic coated aluminum tape to a wider steel tape with one edge of the aluminum tape registering with one edge of the steel tape, forming the corrugated laminated tape around a cable core with the uncovered portion of the steel tape overlapping the registering edges of the laminated tape, and extruding an outer jacket of polyethylene over the corrugated laminated tape.

15 Claims, 3 Drawing Figures

METHOD AND APPARATUS FOR MANUFACTURING CABLES HAVING COMPOSITE SHIELD AND ARMOR SHEATH DESIGNS

This invention relates to a method and an apparatus for manufacturihg cables having composite shield and armour sheath designs A typical example of a composite shield and armour sheath design is the ASP (aluminum, steel, polyethylene) sheath which is conventionally placed over multipair communication cable cores to provide electromagnetic shielding, protection from lightning, and mechanical protection of the cable core. This sheath is typically used on filled cable cores for direct burial applications where mechanical protection is necessary for installation and to prevent damage to the cable caused by gnawing rodents.

The sheath normally consists of a corrugated aluminum tape (typically 0.008" thick available with or without a plastic coating on both sides of the tape) longitudinally formed around the cable core with a gap of approximately $\frac{1}{8}$"-$\frac{1}{4}$" remaining between the tape edges. To provide the necessary mechanical protection a corrugated steel tape (typically 0.006" thick available with or without a plastic coating on both sides) is formed over the corrugated aluminum tape and applied with an overlap. A polyethylene jacket is extruded overall. Voids that exist under the aluminum, between the aluminum and steel tape, and between the steel tape and the polyethylene jacket are filled with suitable compounds to prevent the migration of water along the cable and prevent corrosion of aluminum and steel tapes if uncoated tapes are used.

Sheath designs which utilize a plastic coated aluminum tape and uncoated steel are sometimes referred to as a CASP (coated aluminum steel polyethylene) sheath while cables with both a coated aluminum and coated steel tape are sometimes referred to as a CACSP (coated aluminum coated steel polyethylene) sheath.

A typical manufacturing line for the manufacture of the ASP, CASP or CACSP sheath involves paying off the individual aluminum and steel tapes, corrugating each tape individually and forming both tapes around the cable core with a tape forming device. The typical manufacturing line requires a payoff, tape splicing station, a device to accumulate tape while splicing on a new length of tape, and a device for corrugating the tapes for each tape (aluminum and steel). Also required is equipment to apply a flooding compound over the cable core, between the corrugated tapes, and equipment to apply a flooding compound over the formed corrugated tapes.

The above manufacturing line has several disadvantages in processing and design:

(a) It requires duplicate pieces of equipment for processing the aluminum and steel tapes, that is two tape splicing stations, two tape accumulators and two corrugators.

(b) The corrugations of the aluminum and steel tapes do not always align themselves (it is difficult to maintain "registration") resulting in a cable of larger size. In addition, a possible water path may be formed between the two tapes.

It is therefore the object of the present invention to provide a new method for manufacturing the ASP, CASP or CACSP sheath which involves bonding the aluminum and steel tapes together and processing the laminated tape as a single tape. This idea has been disclosed in U.S. Pat. No. 3,360,409 issued Dec. 26, 1967. However, the manufacturing process disclosed in the above patent suffers from a major drawback: the edges of the laminated tape are welded together after having been formed around the cable core. This automatically eliminates the possibility of introducing a flooding compound between the cable core and the sheath to provide a water tight construction because the presence of the flooding compound is not compatible with welding.

The manufacturing process, in accordance with the present invention, comprise the steps of corrugating a laminated tape formed by bonding a plastic coated aluminum tape to a wider steel tape with one edge of the aluminum tape registering with one edge of the steel tape, forming the corrugated laminated tape around a cable core with the uncovered portion of the steel tape overlapping the registering edges of the laminated tape, and extruding an outer jacket of polyethylene over the corrugated laminated tape.

In a first embodiment of the invention, the tape is pre-laminated, that is the steel and plastic coated aluminum tapes are bonded together in an off-line operation.

In a second embodiment of the invention, the aluminum and steel tapes are laminated in line with the sheathing operation.

When using a pre-laminated tape, individual lengths of laminated tape are preferably joined together and fed to an accumulator so as to allow the sheathing operation to continue while a new roll of laminated tape is loaded and joined to the existing tape to form a continuous tape. Similarly, when the aluminum and steel tapes are laminated in line with the sheathing operation, separate individual lengths of aluminum and steel tapes are joined together and fed to respective accumulators so as to allow a continuous sheathing operation while new rolls of aluminum and steel tapes are loaded and jointed to the respective continuous tapes.

Simple overlapping of the corrugated laminated tape during forming of the tape around the cable core allows complete filling of the inside corrugations of the tape once the tape is formed around the cable core so as to provide a water tight construction.

The invention will now be disclosed, by way of example, with reference to the accompanying drawings in which.

Figure 1:
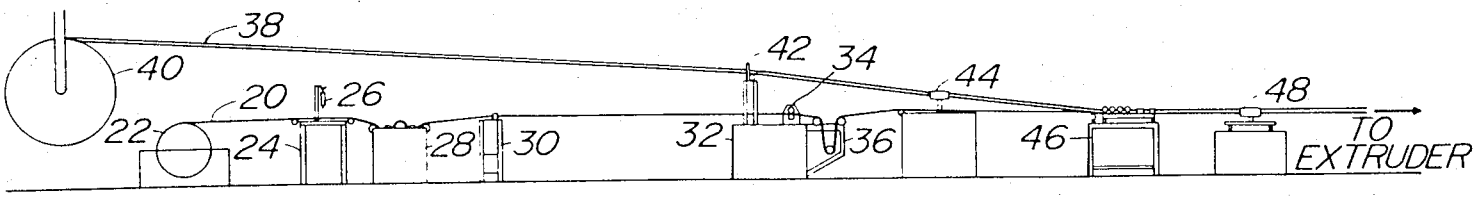
FIG. 1 is a schematic diagram illustrating the manufacture of a composite shield and armour sheath design with a pre-laminated aluminum and steel tape.

The process for manufacture of a cable having a shield and armour sheath design using a pre-laminated aluminum-steel tape is shown in FIG. 1. In this process, the steel and plastic coated aluminum tapes are bonded, together in an off line operation. In the sheathing process the laminated tape is corrugated and formed around a cable core with an overlap. A polyethylene jacket is applied overall.

Figure 2:
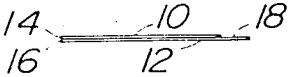
FIG. 2 is a cross section view of the laminated tape.

As shown in FIG. 2, a plastic coated aluminum tape 10 is bonded to a wider steel tape 12 with one edge 14 of the aluminum tape registering with one edge 16 of the steel tape. The uncovered portion 18 of the steel tape extends out by a predetermined amount so as to insure a uniform predetermined overlap of the tape when the tape is formed around the cable as it will be disclosed later. The plastic coated aluminum tape is preferably pressure bonded to the steel tape although other suitable bonding techniques are also envisaged.

In the assembly line shown in FIG. 1, a pre-laminated aluminum and steel tape 20, such as shown in FIG. 2, is payed off from a roll 22 and passes over a splice table 24 where individual lengths of laminated tape are joined together by means of spot welder 26.

The continuous laminated tape is then passed through an accumulator 28. This device allows an excess of tape to be dereeled off the pay off roll and stored in the accumulator. The sheathing process can thus continue while a new roll of laminated tape is loaded and spliced to the existing tape.

The laminated tape then passes through a device 30 which deposits a thin layer of oil on the tape to reduce the friction of the subsequent tape forming operation.

The laminated tape then passes through a corrugator 32 equiped with two inter-meshing rollers 34 which corrugate the tape into a sinusoidal like pattern. Before leaving the corrugator, the tape is passed through a bath 36 containing a cleaning solution to remove the oil from the tape.

The cable core 38 to be sheathed is paid off from a reel 40 and is guided over the corrugator by guiding device 42 and then passes through a device 44 which deposits a thin layer of filling compound over the cable core. This filling compound will completely fill the corrugations inside the tape once the corrugated laminated tape is formed around the cable core.

The cable core and the corrugated tape are then passed through a conventional device 46 which guides the cable core while forming the corrugated laminated tape around the core. In the final stage of such tape forming operation, the edge 18 (FIG. 2) of the steel tape is forced into overlapping relationship with the registering edges 16 of the laminated aluminum-steel tape.

The sheathed cable core is then passed through a device 48 which applies a flooding compound over the tape. This flooding compound prevents the steel from corroding. The flooding compound may be omitted if a plastic coated steel tape is used. The cable core is then fed to an extruder for applying an outer jacket of polyethylene thereto.

Figure 3:
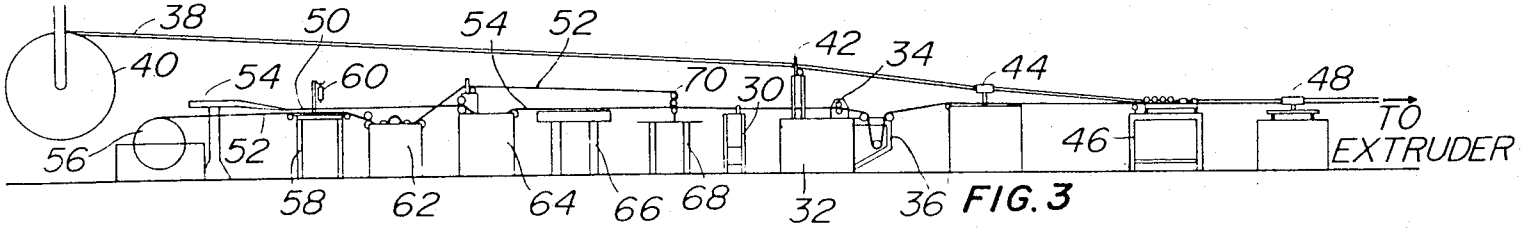
FIG. 3 is a diagram illustrating the manufacture of a cable having a shield and armour sheath design using a laminated tape formed in line with the sheathing operation.

The process for the manufacture of a cable having a shield and armour sheath design using a laminated tape formed in line with the sheathing operation is shown in FIG. 3. In this process, the individual steel and plastic coated tapes are bonded together, corrugated and formed around the cable core. A polyethylene jacket is applied overall.

In detail, individual lengths of steel tape 50 and individual lengths of plastic coated aluminum tape 52 are payed off from their respective rolls 54 and 56. Both tapes pass over a splicing table 58 where the individual lengths of each tape are joined together by means of a spot welder 60.

The aluminum tape then passes through accumulator 62 while the steel tape by-passes accumulator 62 and enters an accumulator 64. The two accumulators allow an excess of tape to be dereeled off the payoff rolls and stored in the accumulators. The sheathing process may thus continue while the rolls of aluminum and steel tape are loaded and joined to their respective tapes.

When exiting the accumulators, the aluminum tape 52 passes above the steel tape 54. The steel tape passes over a radiant heat applicator 66 which raises the temperature of the steel tape.

The aluminum tape comes into contact with the heated steel tape in a device 68 consisting of three rollers 70 vertically in line which guide the aluminum tape above the steel tape and bring the aluminum tape in contact with the steel tape between the bottom two rollers. The combination of the heat of the steel tape and pressure exerted on the steel and coated aluminum tapes by the rollers cause the plastic coating on the aluminum tape to adhere to the steel tape. The two tapes become effectively laminated in a single tape. The laminated tape can then process through the manufacturing operation as a single tape. In the bonding operation, one edge of the aluminum tape is guided such as to register with one edge of the wider steel tape as shown in FIG. 2 of the drawings. The uncovered portion of the steel tape provides the overlap during forming of the tape around the cable core.

The laminated tape passes through lubricating device 30, corrugator 32 including rollers 34, and cleaning bath 36. These elements correspond to the elements designated by the same reference characters in the embodiment of FIG. 1 and are used for the same purpose. Similarly, the cable core 38 is paid off from reel 40, guided over guiding device 42 and passes through compound filler 44, which correspond to the elements designated by the same reference characters in FIG. 1 of the drawings.

Device 46 brings together the cable core and the laminated tape in the same manner as the corresponding element in FIG. 1. This device guides the cable core through rollers and dies while also deflecting and forming the tape around the cable core with an overlap.

A layer of flooding compound is applied to the outside portion of the sheath to prevent corrosion of the steel by device 48 which corresponds to the same element in FIG. 1. This flooding compound applicator may be omitted if plastic coated steel is used. The sheathed cable is then fed to an extruder for applying an outer jacket of polyethylene over the cable.

Although the sheathing process has been disclosed with reference to preferred embodiment, it is to be understood that other alternatives are also envisaged and that the invention is to be limited by the scope of the claims only.

I claim:

1. A process for manufacturing a cable having a composite shield and armour sheath design comprising the steps of:

(a) bonding a plastic coated aluminum tape to a wider steel tape with one edge of the aluminum tape registering with one edge of the steel tape and the other edge of the aluminum tape spaced inwardly of the other edge of the steel tape to define an uncovered portion of the laminated tape;

(b) corrugating the laminated tape;

(c) forming the corrugated laminated tape around a cable core with the uncovered portion of the laminated tape overlapping the registered edges of the laminated tape so as to provide a uniform unwelded overlap; and (d) extruding an outer jacket of polyethylene over the corrugated laminated tape.

2. A process as defined in claim 1, wherein the steel and plastic coated aluminum tapes are bonded together in an off line operation.

3. A process as defined in claim 1, wherein the steel and plastic coated aluminum tapes are bonded together in an in line operation.

4. A process as defined in claim 2, further comprising the steps of joining together individual lengths of laminated tape wound in separate rolls, and feeding the so produced continuous laminated tape to an accumulator so as to allow the sheathing operation to continue while a new roll of laminated tape is loaded and joined to make the continuous laminated tape.

5. A process as defined in claim 3, comprising the steps of joining together individual lengths of steel tape and individual lengths of plastic coated aluminum tape so as to form continuous steel and plastic coated aluminum tapes, feeding the separate continuous steel and plastic coated aluminum tapes to respective accumulators so as to allow the sheathing operation to continue while the rolls of steel and aluminum tapes are loaded and joined to their respective tapes, and bonding together the continuous steel and aluminum tapes exiting from their respective accumulators to form said laminated tape.

6. A process as defined in claim 4, further comprising the step of applying a layer of filling compound over the cable core prior to forming the corrugated laminated tape around the cable core so as to fill the corrugations inside the laminated tape during forming of the tape around the cable core and so provide a water tight construction.

7. A process as defined in claim 1, further comprising the step of applying a layer of flooding compound over the corrugated laminated tape prior to the extrusion of the outer jacket of polyethylene to prevent corrosion of the steel tape.

8. A process as defined in claim 1, wherein the steel tape is plastic coated and wherein the outer jacket of polyethylene is applied directly over the corrugated laminated tape.

9. An apparatus for manufacturing a cable having a composite shield and armour sheath design comprising:

(a) means for bonding a plastic coated aluminum tape to a wider steel tape with one edge of the aluminum tape registering with one edge of the steel tape and the other edge of the aluminum tape spaced inwardly of the other edge of the steel tape to define an uncovered portion of the laminated tape;

(b) means for corrugating the laminated tape;

(c) means for forming the corrugated laminated tape around a cable core so that the uncovered portion of the steel tape overlaps the registering edges of the laminated tape so as to provide a uniform unwelded overlap; and (d) means for extruding an outer jacket of polyethylene over the corrugated laminated tape.

10. An apparatus as defined in claim 9, wherein the steel and plastic coated aluminum tapes are bonded together in an off line operation.

11. An apparatus as defined in claim 9, wherein the steel and plastic coated aluminum tapes are bonded together in an in line operation.

12. An apparatus as defined in claim 9, further comprising means for joining together individual lengths of laminated tape wound on separate rolls, and an accumulator for storing the so produced continuous laminated tape so as to allow the sheathing operation to continue while a new roll of laminated tape is loaded and joined to the continuous laminated tape.

13. An apparatus as defined in claim 9, further comprising means for joining together individual lengths of steel tape and individual lengths of aluminum tape so as to produce separate continuous steel and aluminum tapes, separate accumulators for storing the respective continuous steel and aluminum tapes so as to allow the sheathing operation to continue while the rolls of steel and aluminum tapes are loaded and joined to their respective tapes, and means for bonding together the continuous steel and aluminum tapes exiting from their respective accumulators to form said laminated tape.

14. An apparatus as defined in claim 12, further comprising means for depositing a thin layer of filling compound over the cable core so as to fill the corrugations inside the laminated tape during forming of the tape around the cable core and so provide a water tight construction.

15. An apparatus as defined in claim 12, further comprising means for applying a layer of flooding compound over the corrugated tape prior to extrusion of the outer jacket of polyethylene to prevent corrosion of the steel tape.

* * * * *